US010667974B2

(12) United States Patent
Wright

(10) Patent No.: US 10,667,974 B2
(45) Date of Patent: Jun. 2, 2020

(54) SLING FOR USE IN MOVING PERSONS WITH LIMITED MOBILITY

(71) Applicant: Donald W. Wright, Duncan (CA)

(72) Inventor: Donald W. Wright, Duncan (CA)

( * ) Notice: Subject to any disclaimer, the term of this patent is extended or adjusted under 35 U.S.C. 154(b) by 0 days.

(21) Appl. No.: 16/423,856

(22) Filed: May 28, 2019

(65) Prior Publication Data

US 2019/0358107 A1 Nov. 28, 2019

Related U.S. Application Data

(60) Provisional application No. 62/677,300, filed on May 29, 2018.

(51) Int. Cl.
*A61G 7/10* (2006.01)

(52) U.S. Cl.
CPC ..... *A61G 7/1023* (2013.01); *A61G 2200/34* (2013.01)

(58) Field of Classification Search
CPC ..... A61G 7/1023; A61G 2200/34
USPC ..... 294/140; 5/81.1 T, 89.1
See application file for complete search history.

(56) References Cited

U.S. PATENT DOCUMENTS 1,035,642 A * 8/1912 Rosse ..... A61G 7/1023 294/140
3,234,568 A 2/1966 Fischer
3,968,911 A * 7/1976 Haas ..... A47D 13/02 224/158
5,530,975 A 7/1996 Firebaugh et al.
5,663,995 A * 9/1997 Hu ..... A61B 6/032 378/15
6,073,280 A * 6/2000 Farnum ..... A61F 5/03 128/876
6,101,634 A * 8/2000 Martinez ..... A61G 7/1023 128/845
6,196,229 B1 * 3/2001 Piazza ..... A61G 7/1023 128/869
6,289,534 B1 9/2001 Hakamiun et al.
7,168,110 B2 * 1/2007 Girard ..... A61G 1/01 5/627
7,624,458 B2 12/2009 Felling
8,281,430 B1 * 10/2012 Hough ..... A61G 7/1051 5/625
8,783,709 B1 7/2014 Westermann et al.
9,066,842 B2 6/2015 Partridge et al.
9,089,459 B2 7/2015 Dindas et al.
9,241,849 B1 1/2016 Caskey
9,259,368 B2 2/2016 Jensen et al.
9,278,038 B2 * 3/2016 Masucci ..... A61G 7/1023
9,364,375 B2 6/2016 Youngmann et al.
9,433,548 B2 * 9/2016 Dovervik ..... A61G 7/1051
D777,062 S 1/2017 Beaulieu et al.
9,561,144 B2 2/2017 MøLler
9,579,240 B2 2/2017 Krolick et al.
(Continued)

*Primary Examiner* — Paul T Chin
(74) *Attorney, Agent, or Firm* — Tomlinson McKinstry, P.C.

(57) ABSTRACT

A flexible fabric sling for use by two attendants in lifting and transporting a person with limited mobility, the sling including a thigh band releasably securable about the person's thighs, a torso band releasably securable about the person's torso, a dorsal strap extending between the thigh band and the torso band, and handles graspable by the attendants. The length of the dorsal strap is adjustable to accommodate persons of different heights.

20 Claims, 6 Drawing Sheets

(56) References Cited

U.S. PATENT DOCUMENTS

| | | | | |
|---|---|---|---|---|
| D786,143 | S | 5/2017 | Couch | |
| 9,675,509 | B2 | 6/2017 | Tilk et al. | |
| 9,889,053 | B2 | 2/2018 | Caskey | |
| 9,925,098 | B2 | 3/2018 | Lambarth et al. | |
| 9,943,457 | B2 | 4/2018 | Starr | |
| 9,980,866 | B2 | 5/2018 | Moller | |
| D824,601 | S | 7/2018 | Fallgatter | |
| 10,080,693 | B1 | 9/2018 | Scheenstra et al. | |
| 10,080,694 | B1 | 9/2018 | Scheenstra et al. | |
| 10,188,572 | B2 | 1/2019 | Bochner et al. | |
| 10,206,830 | B2 | 2/2019 | Fowler et al. | |
| 10,258,520 | B1 | 4/2019 | Beltran | |
| 10,258,527 | B2 | 4/2019 | Rodriguez | |
| 2003/0192118 | A1 | 10/2003 | Carbonneau et al. | |
| 2012/0018466 | A1* | 1/2012 | Topaz ..... | A61G 1/01<br>224/158 |

* cited by examiner

SLING FOR USE IN MOVING PERSONS WITH LIMITED MOBILITY

FIELD OF THE INVENTION

The present invention relates to the field of devices for people with limited mobility, particularly sling devices for supporting and transporting people with limited mobility.

BACKGROUND OF THE INVENTION

Flexible (e.g., fabric or webbing) slings for supporting and transporting persons with limited mobility are known.

For example, U.S. Pat. No. 3,234,568, (Fischer, LIFTING AND TRANSPORTING SLING FOR PERSONS), discloses a lifting and transporting device that consists of a sling and a transport frame. The sling features back and leg supports, and is adapted to hook on to a moveable frame.

As a further example, U.S. Pat. No. 6,289,534, (Hakamium et al., PATIENT LIFT) discloses an assembly for lifting, supporting and transporting a person, consisting of a frame, a lifting arm and a sling assembly comprising a back supporting portion and a thigh supporting portion with fabric flaps that cross between the supported person's legs.

As a further example, U.S. Pat. No. 7,624,458, Felling, (PERSONAL TRANSFER AND CARRIER SLING), discloses a sling consisting of a back support and two leg flaps that in use appear to cross under the patient's thighs and be secured around the patient's shins.

As a further example, U.S. Pat. No. 8,281,430, (Hough et al., SLING FOR EXTRACTING AND TRANSPORTING PEOPLE) discloses a sling consists of a webbing lattice with four loop handles to enable four persons to support and carry a patient in a reclining position.

SUMMARY OF THE INVENTION

In one aspect, the present invention provides a sling for sling for use by two attendants in lifting and transporting a person with limited mobility, that is releasably secured to the patient in use and that enables supporting and transporting the person in an upright sitting position.

In another aspect, the present invention provides a sling for use by two attendants in lifting and transporting a person with limited mobility, the sling including: a releasably securable thigh band; a releasably securable torso band; a dorsal strap extending between the thigh band and the torso band, wherein the length of the dorsal strap is adjustable; two seat handles attached to the thigh band; and one or more side handles attached to the torso band at a dorsal region of the torso band; wherein, in use: the length of the dorsal strap is adjusted for the height of a person with limited mobility; with the dorsal strap located dorsal to the person: the thigh band is releasably secured about the thighs of the person; and the torso band is releasably secured about the torso of the person; and lifting of the person by two attendants comprises: one attendant grasping one of the seat handles; the other attendant grasping the other of the seat handles; and the attendants grasping the one or more side handles.

The thigh band has a thigh band circumferential length when the thigh band is releasably secured and the thigh band circumferential length may be adjustable; and the torso band has a torso band circumferential length when the torso band is releasably secured and the torso band circumferential length may be adjustable.

The thigh band may include: an inner thigh band; an outer thigh band; and means for adjustably releasably connecting the inner thigh band to the outer thigh band; and the torso band may include: an inner torso band; an outer torso band; and means for adjustably releasably connecting the inner torso band to the outer torso band.

The means for adjustably releasably connecting the inner thigh band to the outer thigh band may include: a first buckle component attached to the outer thigh band in the vicinity of a distal end of the outer thigh band; and a second buckle component configured for releasable connection with the first buckle component and positionable on an outside of the inner thigh band in a range of positions extending proximal from the vicinity of a distal end of the inner thigh band; and the means for adjustably releasably connecting the inner torso band to the outer torso band may include: a third buckle component attached to the outer torso band in the vicinity of a distal end of the outer torso band; and a fourth buckle component configured for releasable connection with the third buckle component and positionable on an outside of the inner torso band in a range of positions extending proximal from the vicinity of a distal end of the inner torso band.

The second buckle component may be mounted on a thigh adjustment webbing having a first end affixed to the inner thigh band in the vicinity of the distal end of the inner thigh band and a second end affixed to the inner thigh band proximal of the first end, wherein the second buckle component: may be slidable along the thigh adjustment webbing when the thigh adjustment webbing is slack; and may tend to remain in position along the thigh adjustment webbing when the thigh adjustment webbing is under tension; and the fourth buckle component may be mounted on a torso adjustment webbing having a first end affixed to the inner torso band in the vicinity of the distal end of the inner torso band and a second end affixed to the inner torso band proximal of the first end, wherein the fourth buckle component: may be slidable along the torso adjustment webbing when the torso adjustment webbing is slack; and may tend to remain in position along the torso adjustment webbing when the torso adjustment webbing is under tension.

A thigh adjustment strip of one of a hook or a loop of a hook and loop fastener may be attached to the thigh adjustment webbing and a thigh adjustment strip of the other of the hook or the loop of the hook and loop fastener may be attached to the inside of the outer thigh band, wherein the thigh adjustment hook and loop strips are engageable one with the other when the first buckle component is connected to the second buckle component; and a torso adjustment strip of one of a hook or a loop of a hook and loop fastener may be attached to the torso adjustment webbing and a torso adjustment strip of the other of the hook or the loop of the hook and loop fastener may be attached to the inside of the outer torso band, wherein the torso adjustment hook and loop strips may be engageable one with the other when the third buckle component is connected to the fourth buckle component.

The dorsal strap may include: a thigh dorsal strap, integral with the thigh band; a torso dorsal strap, integral with the torso band; and means for releasably attaching the thigh dorsal strap and the torso dorsal strap one to the other in a range of lengths.

One of the thigh dorsal strap and the torso dorsal strap may include a tang having one of a hook component or a loop component of a hook and loop fastener on both an inside and an outside of the tang; and the other of the thigh dorsal strap and the torso dorsal strap may include: two flaps, each flap having the other of the hook component or the loop component of the hook and loop fastener on the side of the flap facing the other flap; a pocket suitable for receiving the tang with an entrance of the pocket in the vicinity of a proximal end of each flap; whereby, the thigh dorsal strap and the torso dorsal strap may be releasably attachable one to the other in a range of lengths by: interposing the tang between the flaps; or interposing the tang between the flaps and inserting a distal portion of the tang into the pocket; and engaging the hook components with the loop components.

Each seat handle may include webbing and may be attached to the thigh band in a dorsal region of the thigh band.

The one or more side handles may include webbing and there may be two side handles.

The sling may include one or more front handles, each front handle comprising webbing and being attached to the torso band at a ventral region of the torso band.

The sling may include one or more lifting lugs for engagement with a lift connector and located in a superior dorsal region of the torso band.

Each handle may include identifying indicia. The identifying indicia may be a contrasting colour; a light reflective material; or both.

The sling is preferably made from a washable synthetic fabric.

In another aspect, the present invention provides a sling for use by two attendants in lifting and transporting a person with limited mobility, the sling including: a releasably securable thigh band having a thigh band circumferential length when the thigh band is releasably secured wherein the thigh band circumferential length is adjustable; a releasably securable torso band having a torso band circumferential length when the torso band is releasably secured wherein the torso band circumferential length is adjustable; a length-adjustable dorsal strap comprising: a thigh dorsal strap, integral with the thigh band; a torso dorsal strap, integral with the torso band; and means for releasably attaching the thigh dorsal strap and the torso dorsal strap one to the other in a range of lengths; two seat handles attached to the thigh band; and one or more side handles attached to the torso band at a dorsal region of the torso band; wherein, in use: the length of the dorsal strap is adjusted for the height of a person with limited mobility; with the dorsal strap located dorsal to the person: the thigh band is releasably secured about the thighs of the person; and the torso band is releasably secured about the torso of the person; and lifting of the person by two attendants comprises: one attendant grasping one of the seat handles; the other attendant grasping the other of the seat handles; and the attendants grasping the one or more side handles.

The thigh band may include: an inner thigh band; an outer thigh band; and a first buckle component attached to the outer thigh band in the vicinity of a distal end of the outer thigh band; and a second buckle component configured for releasable connection with the first buckle component and mounted on a thigh adjustment webbing having a thigh adjustment webbing first end affixed to the inner thigh band in the vicinity of the distal end of the inner thigh band and a thigh adjustment webbing second end affixed to the inner thigh band proximal of the thigh adjustment webbing first end, wherein the second buckle component: is slidable along the thigh adjustment webbing when the thigh adjustment webbing is slack; and tends to remain in position along the thigh adjustment webbing when the thigh band is releasably secured so as to bring thigh adjustment webbing under tension.

The torso band may include: an inner torso band; an outer torso band; and a third buckle component attached to the outer torso band in the vicinity of a distal end of the outer torso band; and a fourth buckle component configured for releasable connection with the third buckle component and mounted on a torso adjustment webbing having a torso adjustment webbing first end affixed to the inner torso band in the vicinity of the distal end of the inner torso band and a torso adjustment webbing second end affixed to the inner torso band proximal of the torso adjustment webbing first end, wherein the fourth buckle component: is slidable along the torso adjustment webbing when the torso adjustment webbing is slack; and tends to remain in position along the torso adjustment webbing when the torso band is releasably secured so as to bring the torso adjustment webbing under tension.

One of the thigh dorsal strap and the torso dorsal strap may include a tang having one of a hook component or a loop component of a hook and loop fastener on both an inside and an outside of the tang; and the other of the thigh dorsal strap and the torso dorsal strap may include: two flaps, each flap having the other of the hook component or the loop component of the hook and loop fastener on the side of the flap facing the other flap; a pocket suitable for receiving the tang with an entrance of the pocket in the vicinity of a proximal end of each flap; whereby, the thigh dorsal strap and the torso dorsal strap are releasably attachable one to the other in a range of lengths by: interposing the tang between the flaps; or interposing the tang between the flaps and inserting a distal portion of the tang into the pocket; and engaging the hook components with the loop components.

Each seat handle may include webbing and may be attached to the thigh band in a dorsal region of the thigh band. The one or more side handles may include webbing and there may be two side handles.

The sling may include one or more front handles, each front handle comprising webbing and being attached to the torso band at a ventral region of the torso band. The sling may include one or more lifting lugs for engagement with a lift connector and located in a superior dorsal region of the torso band.

DETAILED DESCRIPTION WITH REFERENCE TO THE DRAWINGS

Figure 1:
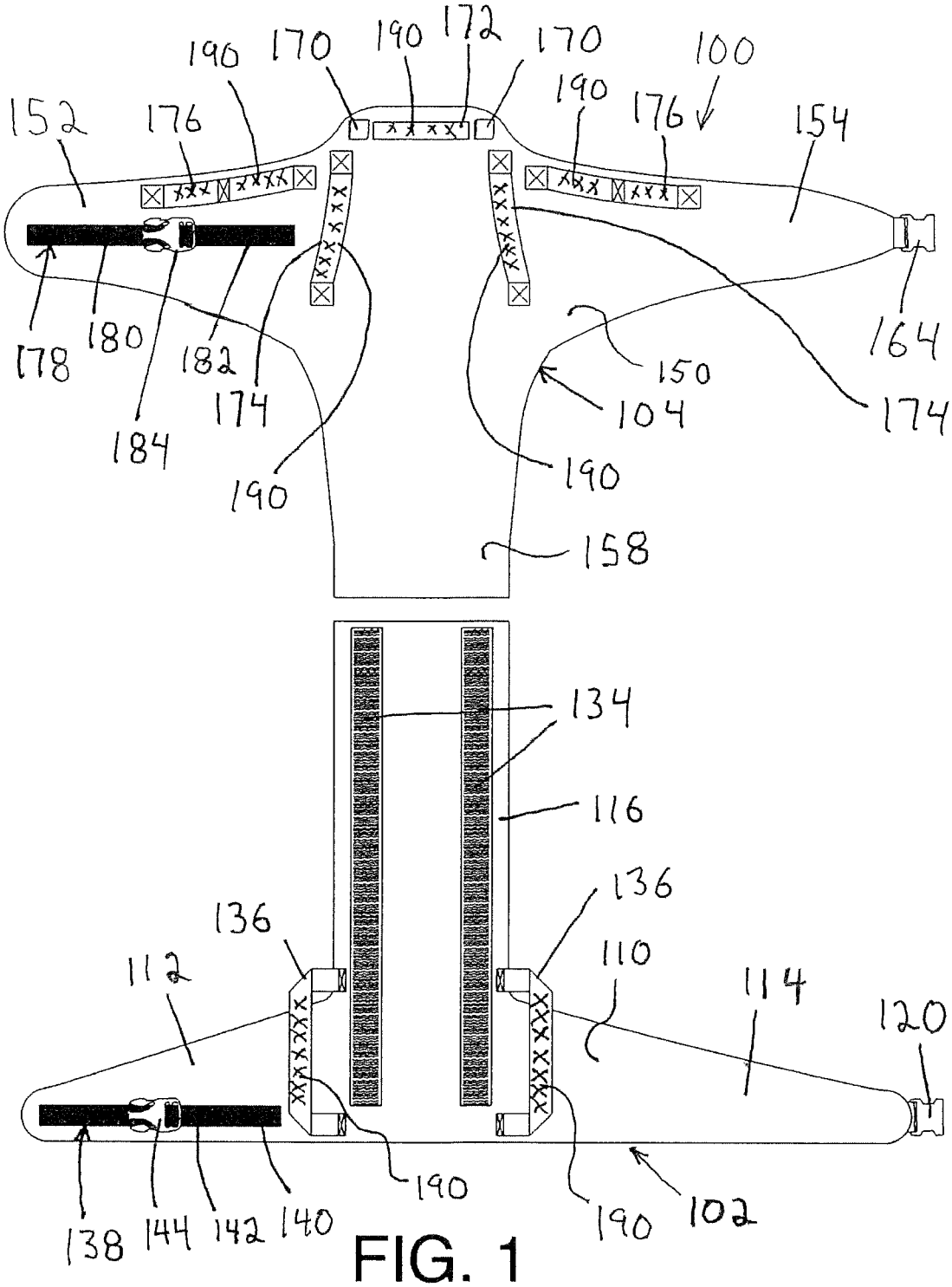
FIG. 1 is plan view of an adjustable sling embodiment of the present invention showing the outside surfaces of the seat assembly and torso assembly, shown detached one from the other.
Figure 2:
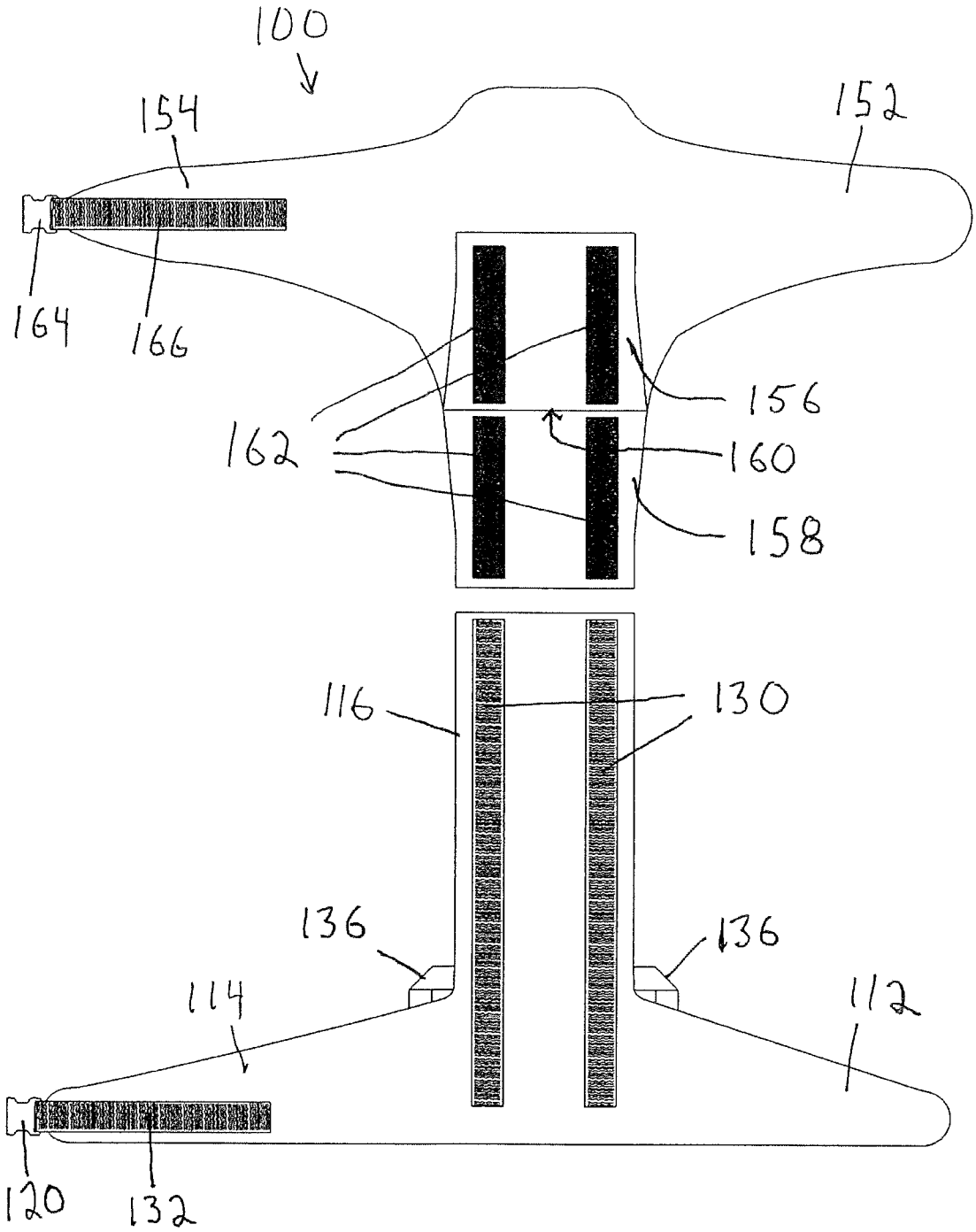
FIG. 2 is a plan view of the adjustable sling embodiment of FIG. 1, showing the inside surfaces of the seat assembly and torso assembly, shown detached one from the other and showing the inside dorsal flap folded in a full-open position.
Figure 3:
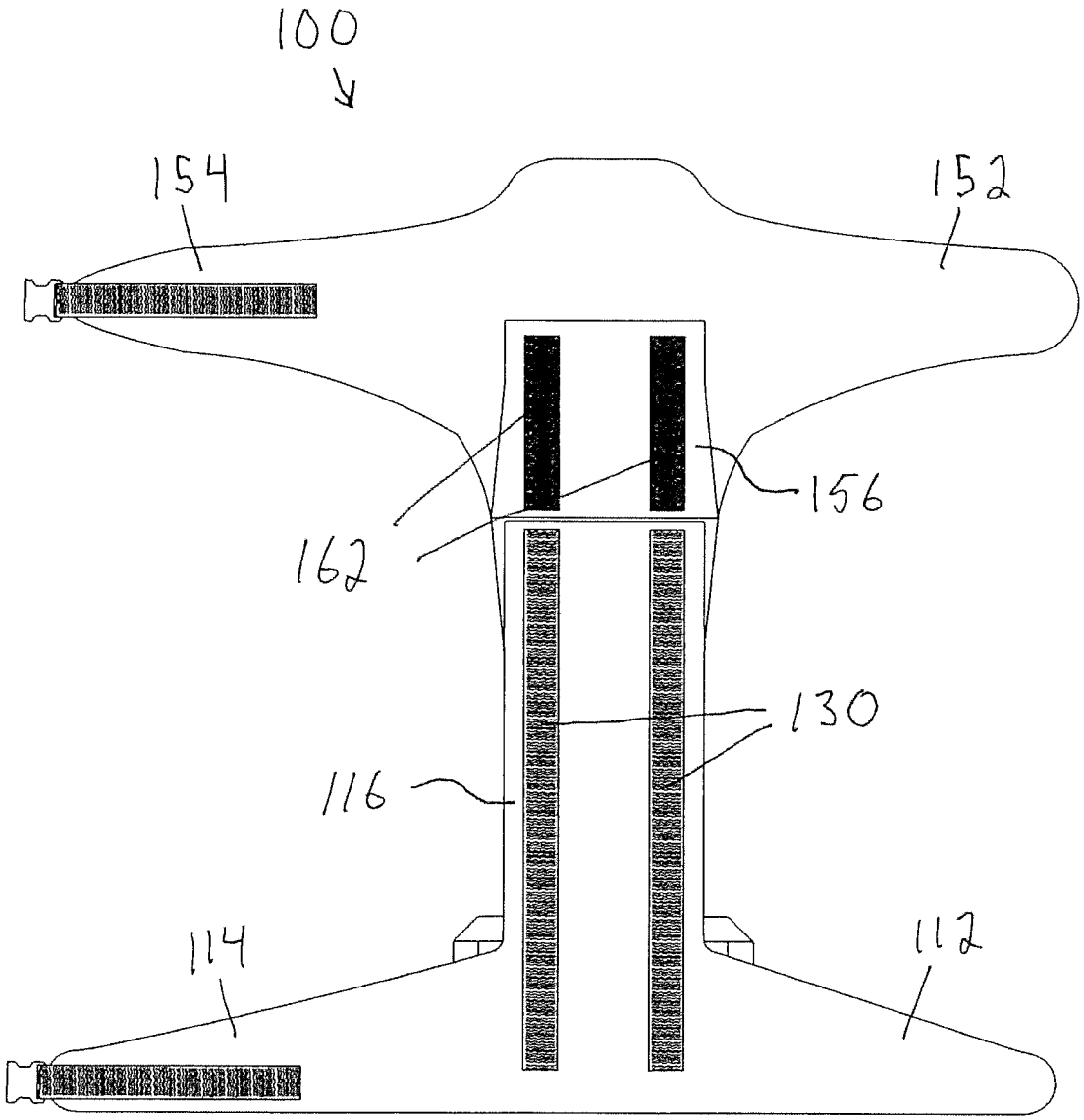
FIG. 3 is a plan view of the adjustable sling embodiment of FIG. 1, showing the inside surfaces of the seat assembly and torso assembly, and showing the inside dorsal flap folded in a full-open position and showing a distal portion of the dorsal tang overlying the outside dorsal flap.
Figure 4:
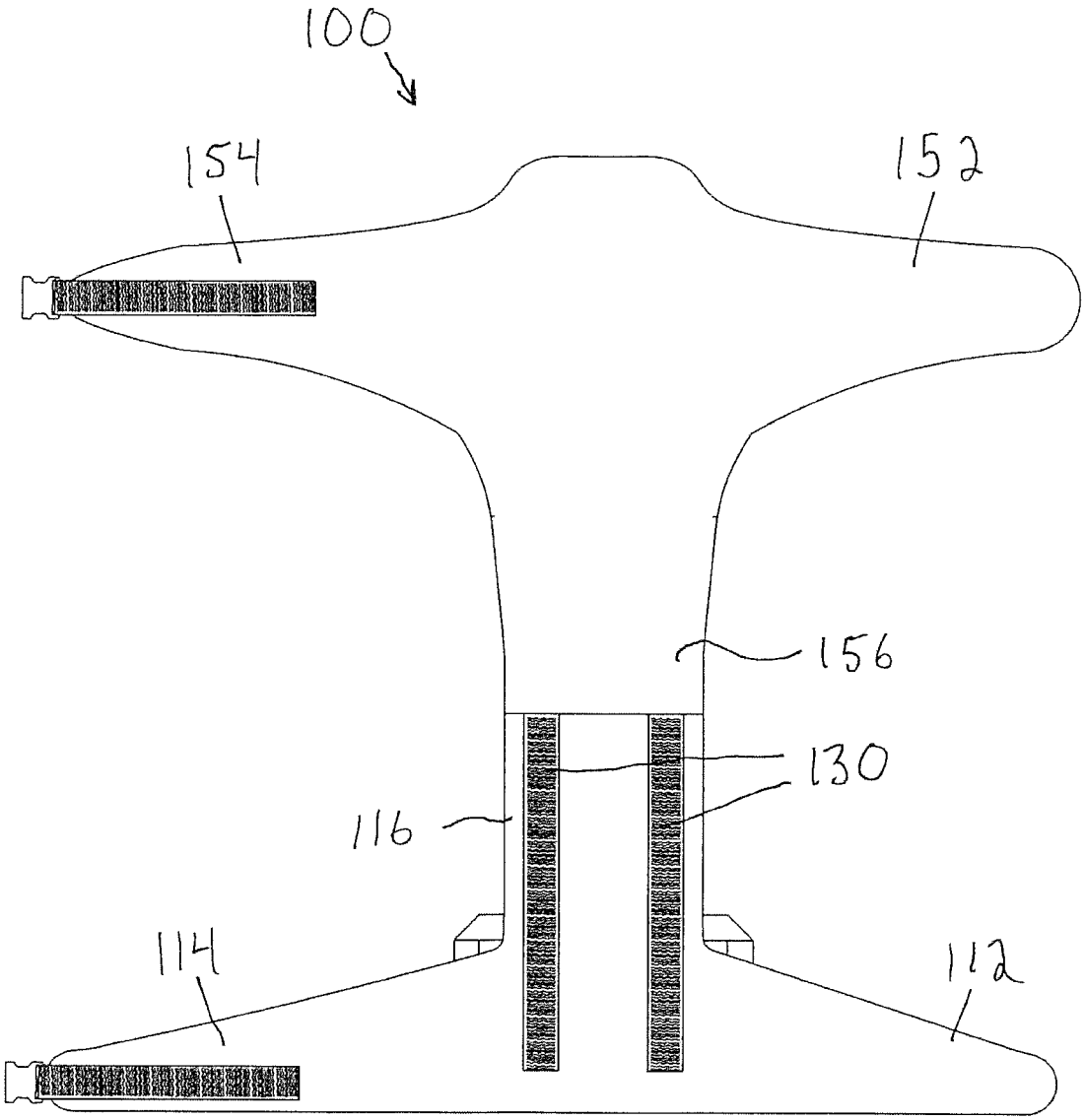
FIG. 4 is a plan view of the adjustable sling embodiment of FIG. 1, showing the inside surfaces of the seat assembly and torso assembly, shown with the seat assembly and torso assembly attached to each other.
Figure 5:
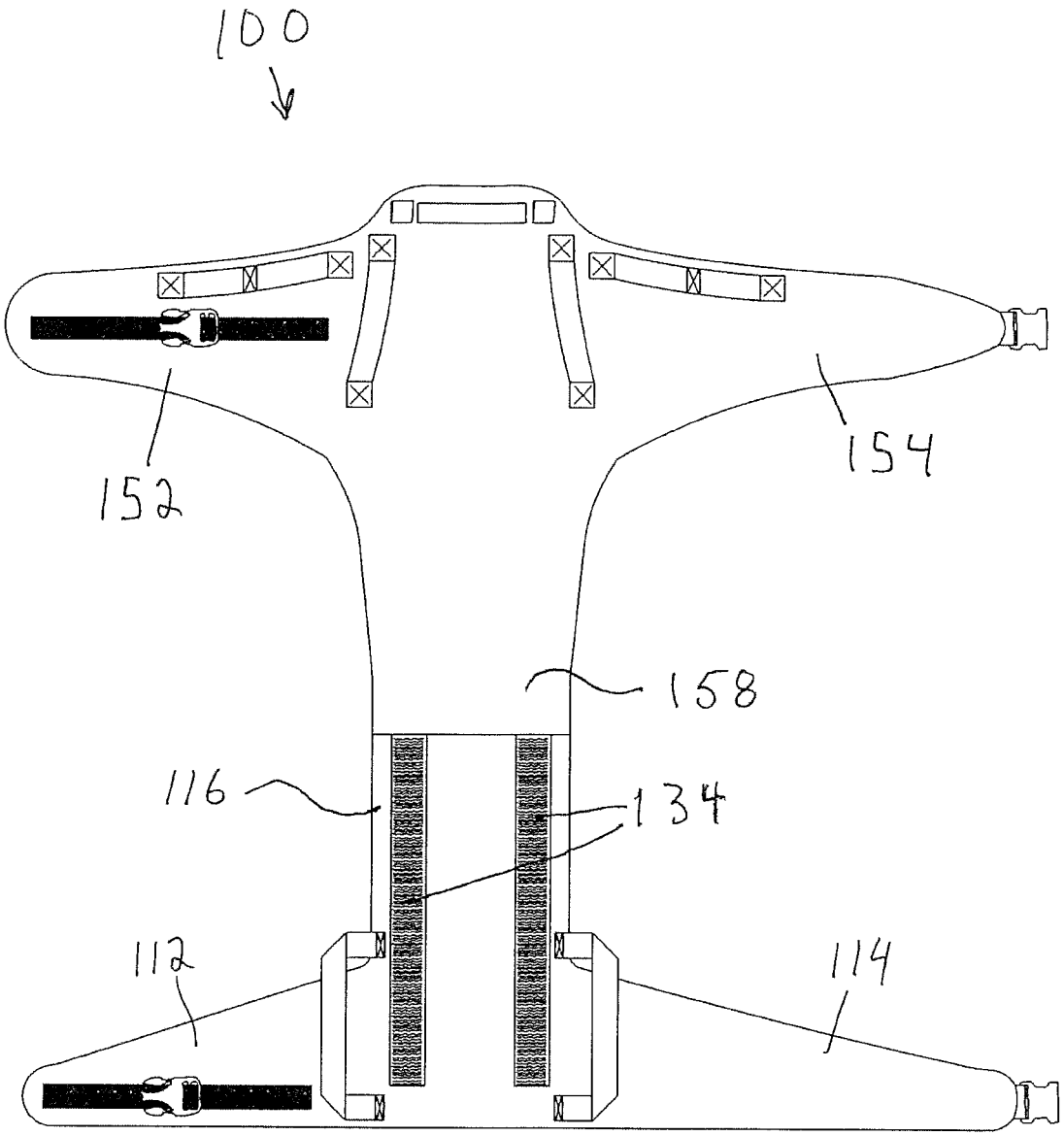
FIG. 5 is a plan view of the adjustable sling embodiment of FIG. 1, showing the outside surfaces of the seat assembly and torso assembly, shown with the seat assembly and torso assembly attached to each other.
Figure 6:
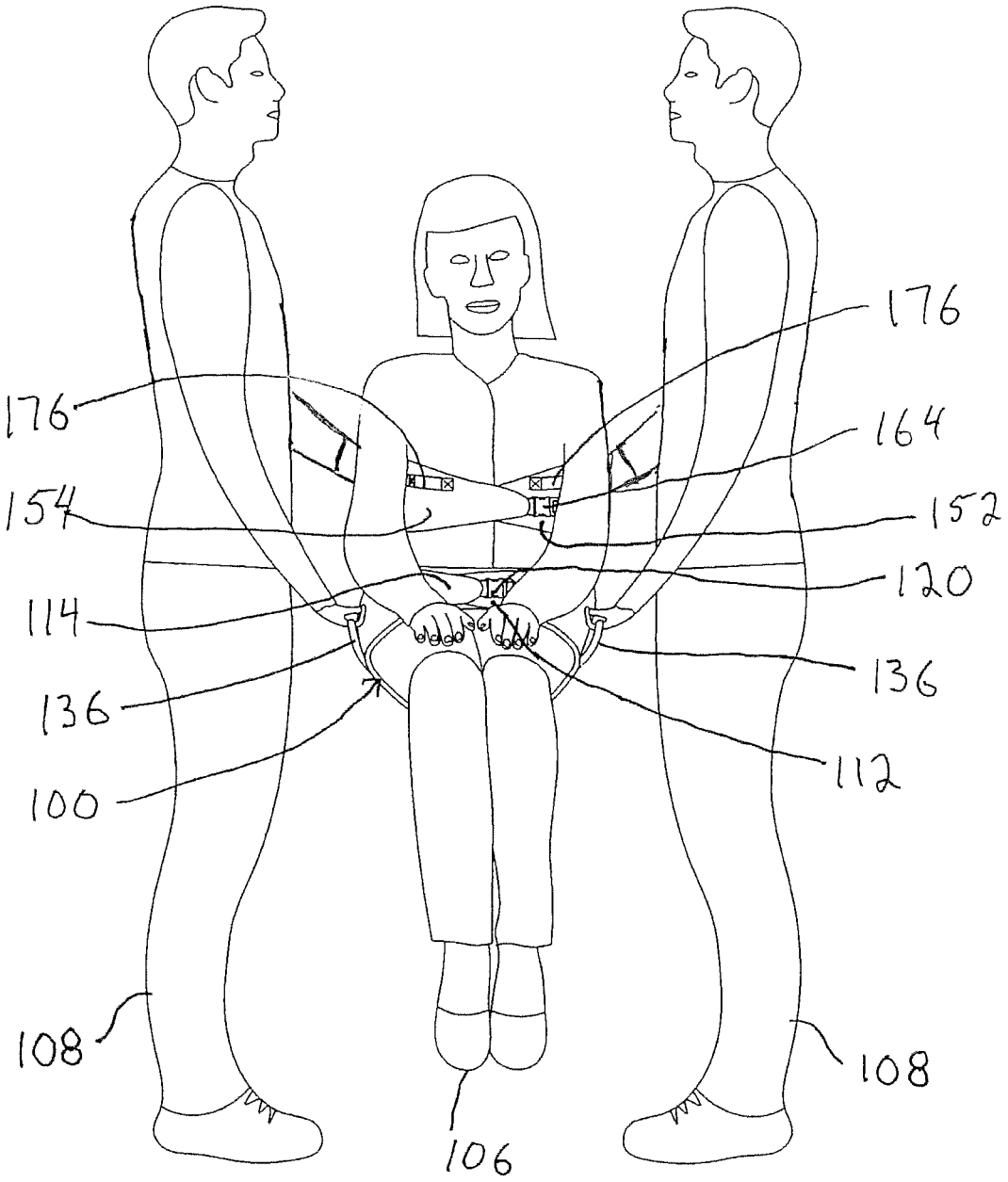
FIG. 6 is an elevation view showing two attendants supporting a patient using the adjustable sling embodiment of FIG. 1.

As shown in the drawings, embodiments of the present invention include an adjustable sling 100, comprising a seat assembly 102, and a torso assembly 104.

In what follows, including in the claims: "patient 106" is use to refer to a person with limited mobility who is supported using the adjustable sling 100; "attendant 108" and "attendants 108" are used to refer to the persons who use the adjustable sling 100 to support a patient 106; "inside" is used to refer to the surfaces of the seat assembly 102 and torso assembly 104 that in use are brought into contact with, or are proximal to, the patient 106; "outside" is used to refer to the surfaces of the seat assembly 102 and torso assembly 104 that are opposite the inside surface; "inner" and "outer" are used to refer to cooperating bands wherein in use the "outer" band in part overlies the "inner" band; "dorsal" is used to refer to locations that are adjacent to or in the vicinity of the dorsal region or back or posterior of the patient 106 when the adjustable sling 100 is in use; "ventral" is used to refer to locations that are adjacent to or in the vicinity of the ventral region or front or anterior of the patient 106 when the adjustable sling 100 is in use; and "superior" is used to indicate towards the head of the patient 106.

The adjustable sling 100 includes conventional hook and loop fastener components (e.g., Velcro™), i.e., the hook strip and loop strip. In the drawings, instances of the hook strip (i.e., the "scratchy" component) are indicated by mottled/greyish longitudinally extending rectangles; and instances of the loop strip are indicated by longitudinally extending rectangles containing spaced-apart wavy lines. In view of their "scratchiness" the hook strips are preferably positioned on the outside surfaces.

The seat assembly 102 comprises a generally T-shaped (shown as an inverted T in the drawings) sewn fabric seat body 110, having an inner thigh band 112, an outer thigh band 114 and dorsal tang 116. A thigh female buckle 120 (being the female part of a conventional plastic quick release buckle) is attached to the distal end of the outer thigh band 114 (i.e., with a short loop of webbing sewn to the fabric comprising the seat body 110).

On the inside of the seat body 110, there are attached: two spaced apart inside dorsal loop strips 130 extending the length of the dorsal tang 116; and a thigh loop strip 132 extending from the distal end of the outer thigh band 114 (i.e., extending from proximate the seat female buckle 120) along the length of the outer thigh band 114.

On the outside of the seat body 110, there are attached two spaced apart outside dorsal loop strips 134 extending the length of the dorsal tang 116; two seat handles 136 and, on the inner thigh band 112, a thigh adjustment assembly 138.

Each seat handle 136 is a piece of webbing sewn at each end to the seat body 110.

The thigh adjustment assembly 138 comprises a thigh adjustment webbing 140, a thigh adjustment hook strip 142 and a thigh male buckle 144. The thigh adjustment webbing 140 and thigh adjustment hook strip 142 are sewn to each other; the combined thigh adjustment webbing 140 and thigh adjustment hook strip 142 are threaded through the webbing receiving portion of the thigh male buckle 144; and one end of the combined thigh adjustment webbing 140 and thigh adjustment hook strip 142 is sewn to the seat body 110 in the vicinity of the distal end of the inner thigh band 112 and the other end of the combined thigh adjustment webbing 140 and thigh adjustment hook strip 142 is sewn to the seat body 110 in the vicinity of the nearest seat handle 136.

When the combined thigh adjustment webbing 140 and thigh adjustment hook strip 142 is not under tension (e.g., when the inner thigh band 112 is folded or curved so as to slacken the combined thigh adjustment webbing 140 and thigh adjustment hook strip 142), the thigh male buckle 144 may be readily manually moved along the length of the combined thigh adjustment webbing 140 and thigh adjustment hook strip 142. When the combined thigh adjustment webbing 140 and thigh adjustment hook strip 142 is under tension (e.g., when the inner thigh band 112 is curved with the outside convex, as when the inner thigh band 112 is around the thighs of a patient 106) the tension tends to cause the thigh male buckle 144 to remain in position along the length of the combined thigh adjustment webbing 140 and thigh adjustment hook strip 142.

The torso assembly 104 comprises a generally t-shaped sewn fabric torso body 150, having an inner torso band 152, an outer torso band 154, an inside dorsal flap 156, an outside dorsal flap 158 and, within the torso body 150, a tang receiving pocket 160. The entrance to the tang receiving pocket 160 is defined by the proximal ends of the inside dorsal flap 156 and outside dorsal flap 158. The faces of the inside dorsal flap 156 and outside dorsal flap 158 that are opposed one to the other, each have two spaced apart dorsal flap hook strips 162.

A torso female buckle 164 is attached to the distal end of the outer torso band 154.

On the inside of the torso body 150, there is attached a torso loop strip 166 extending from the distal end of the outer torso band 154 (i.e., extending from proximate the torso female buckle 164) along the length of the outer torso band 154.

On the outside of the torso body 150, there are attached: two lifting lugs 170; a central handle 172; two side handles 174; two front handles 176; and a torso adjustment assembly 178.

Each lifting lug 170 is a folded piece of webbing sewn to the torso body 150 so as to define an opening for receiving a lift connector (e.g., a hook, carabiner etc.) for connecting to a lifting device.

The central handle 172, side handles 174 and front handles 176 are each a piece of webbing sewn at each end to the torso body 150.

The torso adjustment assembly 178 comprises a torso adjustment webbing 180, a torso adjustment hook strip 182 and a torso male buckle 184, arranged in the same manner as the thigh adjustment webbing 140, thigh adjustment hook strip 142 and thigh male buckle 144. One end of the combined torso adjustment webbing 180 and torso adjustment hook strip 182 is sewn to the torso body 150 in the vicinity of the distal end of the inner torso band 152 and the other end of the combined torso adjustment webbing 180 and torso adjustment hook strip 182 is sewn to the torso body 150 in the vicinity of the nearest side handle 174.

When the combined torso adjustment webbing 180 and torso adjustment hook strip 182 is not under tension (e.g., when the inner torso band 152 is folded or curved so as to slacken the combined torso adjustment webbing 180 and torso adjustment hook strip 182), the torso male buckle 184 may be readily manually moved along the length of the combined torso adjustment webbing 180 and torso adjustment hook strip 182. When the combined torso adjustment webbing 180 and torso adjustment hook strip 182 is under tension (e.g., when the inner torso band 152 is curved with the outside convex, as when the inner torso band 152 is around the torso of a patient 106) the tension tends to cause the torso male buckle 184 to remain in position along the length of the combined torso adjustment webbing 180 and torso adjustment hook strip 182.

Each of the seat handles 136, central handle 172, side handles 174 and front handles 176 preferably has an identifying indicia 190 (e.g., bright color and/or reflectivity—indicated in the drawings by rows of x's) to aid the attendants 108 in locating the relevant handle in low visibility conditions.

In use, the seat assembly 102 and torso assembly 104 are attached one to the other, and the adjustable sling 100 is adjusted for the height of the patient 106, by interposing the dorsal tang 116 between the inside dorsal flap 156 and outside dorsal flap 158 at a position selected by the attendant 108 to be suitable for the height of the patient 106, which may include inserting a distal portion of the dorsal tang 116 into the tang receiving pocket 160. Once the selected position is obtained, the inside dorsal flap 156 and outside dorsal flap 158 are pressed against the dorsal tang 116 so as to bring the inside dorsal loop strips 130 and outside dorsal loop strips 134 into hook and loop engagement with the dorsal flap hook strips 162.

Testing by the applicant indicates that with relatively minimal training and experience, an attendant 108 can fairly reliably select a dorsal tang 116 position between the inside dorsal flap 156 and outside dorsal flap 158 suitable for the height of a patient 106. It may be desirable to mark the dorsal tang 116 with rough indicators for a variety of heights, e.g., 6', 5'6" and 5'.

Once the seat assembly 102 and torso assembly 104 have been attached one to the other at a position suitable for the height of the patient 106, the adjustable sling 100 is positioned under the patient 106, with the seat handles 136 proximate the upper thighs of the patient 106 and the torso assembly 104 at the back of the patient 106.

Then, the inner thigh band 112 and the outer thigh band 114 are secured about the thighs of the patient 106 by moving the thigh male buckle 144 along the thigh adjustment webbing 140 and thigh adjustment hook strip 142 combination to an appropriate position (generally determined by trial and error, i.e., by moving the inner thigh band 112 and the outer thigh band 114 in and out of position about the thighs of the patient 106 so as to enable adjustment of the position of the thigh male buckle 14); and securing the inner thigh band 112 and the outer thigh band 114 one to another by connecting the thigh female buckle 120 and the thigh male buckle 144, and by hook and loop engagement between the thigh loop strip 132 and the thigh adjustment hook strip 142.

Then, the inner torso band 152 and outer torso band 154 are secured about the torso of the patient 106 by moving the torso male buckle 184 along the torso adjustment webbing 180 and torso adjustment hook strip 182 combination to an appropriate position (generally determined by trial and error, i.e., by moving the inner torso band 152 and outer torso band 154 in and out of position about the torso of the patient 106 so as to enable adjustment of the position of the torso male buckle 184); and securing the inner torso band 152 and outer torso band 154 one to another by connecting the torso female buckle 164 and the torso male buckle 184, and by hook and loop engagement between the torso loop strip 166 and the torso adjustment hook strip 182.

If the patient 106 is prone, the attendants 108 may grasp the front handles 176 to bring the patient 106 to a sitting position. With the patient 106 in a sitting position, one attendant 108 grasps a seat handle 136 and a side handle 174, and another attendant 108 grasps the other seat handle 136 and side handle 174, and together the two attendants 108 lift the adjustable sling 100 and patient 106.

With the patient 106 in an upright sitting position, most of the weight of the patient 106 is supported by the seat handles 136; the side handles 174 are primarily used to steady the patient 106. In some instances, e.g., when negotiating difficult terrain, it may be desirable to tilt the patient 106 backwards slightly.

The fabric used in the sling is preferably a washable synthetic heavy weight durable fabric. For patient comfort and cushioning, it may be desirable to provide internal padding in the adjustable sling 100, either throughout or at selected locations, e.g., within the thigh bands and within the dorsal tang. However, the addition of padding should be balanced against the desirability of keeping the adjustable sling 100 light and foldable into a small package, such as for use by emergency first responders.

The scope of the claims should not be limited by the preferred embodiments set forth in the examples, but should be given the broadest interpretation consistent with the description as a whole.

What is claimed is:

1. A sling for use by two attendants in lifting and transporting a person with limited mobility, the sling comprising:

a releasably securable thigh band;

a releasably securable torso band;

a dorsal strap extending between the thigh band and the torso band, wherein the length of the dorsal strap is adjustable;

two seat handles attached to the thigh band; and one or more side handles attached to the torso band at a dorsal region of the torso band;

wherein, in use:

the length of the dorsal strap is adjusted for the height of a person with limited mobility;

with the dorsal strap located dorsal to the person:

the thigh band is releasably secured about the thighs of the person; and the torso band is releasably secured about the torso of the person; and lifting of the person by two attendants comprises:

one attendant grasping one of the seat handles;

the other attendant grasping the other of the seat handles; and the attendants grasping the one or more side handles.

2. The sling of claim 1, wherein:

the thigh band has a thigh band circumferential length when the thigh band is releasably secured and the thigh band circumferential length is adjustable; and the torso band has a torso band circumferential length when the torso band is releasably secured and the torso band circumferential length is adjustable.

3. The sling of claim 1, wherein:

the thigh band comprises:

an inner thigh band;

an outer thigh band; and means for adjustably releasably connecting the inner thigh band to the outer thigh band; and the torso band comprises:

an inner torso band;

an outer torso band; and means for adjustably releasably connecting the inner torso band to the outer torso band.

4. The sling of claim 3 wherein:

the means for adjustably releasably connecting the inner thigh band to the outer thigh band comprises:

a first buckle component attached to the outer thigh band in the vicinity of a distal end of the outer thigh band; and a second buckle component configured for releasable connection with the first buckle component and positionable on an outside of the inner thigh band in a range of positions extending proximal from the vicinity of a distal end of the inner thigh band; and the means for adjustably releasably connecting the inner torso band to the outer torso band comprises:

a third buckle component attached to the outer torso band in the vicinity of a distal end of the outer torso band; and a fourth buckle component configured for releasable connection with the third buckle component and positionable on an outside of the inner torso band in a range of positions extending proximal from the vicinity of a distal end of the inner torso band.

5. The sling of claim 4, wherein;

the second buckle component is mounted on a thigh adjustment webbing having a first end affixed to the inner thigh band in the vicinity of the distal end of the inner thigh band and a second end affixed to the inner thigh band proximal of the first end, wherein the second buckle component:

is slidable along the thigh adjustment webbing when the thigh adjustment webbing is slack; and tends to remain in position along the thigh adjustment webbing when the thigh adjustment webbing is under tension; and the fourth buckle component is mounted on a torso adjustment webbing having a first end affixed to the inner torso band in the vicinity of the distal end of the inner torso band and a second end affixed to the inner torso band proximal of the first end, wherein the fourth buckle component:

is slidable along the torso adjustment webbing when the torso adjustment webbing is slack; and tends to remain in position along the torso adjustment webbing when the torso adjustment webbing is under tension.

6. The sling of claim 5, wherein:

a thigh adjustment strip of one of a hook or a loop of a hook and loop fastener is attached to the thigh adjustment webbing and a thigh adjustment strip of the other of the hook or the loop of the hook and loop fastener is attached to the inside of the outer thigh band, wherein the thigh adjustment hook and loop strips are engageable one with the other when the first buckle component is connected to the second buckle component; and a torso adjustment strip of one of a hook or a loop of a hook and loop fastener is attached to the torso adjustment webbing and a torso adjustment strip of the other of the hook or the loop of the hook and loop fastener is attached to the inside of the outer torso band, wherein the torso adjustment hook and loop strips are engageable one with the other when the third buckle component is connected to the fourth buckle component.

7. The sling of claim 1, wherein the dorsal strap comprises:

a thigh dorsal strap, integral with the thigh band;

a torso dorsal strap, integral with the torso band; and means for releasably attaching the thigh dorsal strap and the torso dorsal strap one to the other in a range of lengths.

8. The sling of claim 7, wherein:

one of the thigh dorsal strap and the torso dorsal strap comprises a tang having one of a hook component or a loop component of a hook and loop fastener on both an inside and an outside of the tang; and the other of the thigh dorsal strap and the torso dorsal strap comprises:

two flaps, each flap having the other of the hook component or the loop component of the hook and loop fastener on the side of the flap facing the other flap;

a pocket suitable for receiving the tang with an entrance of the pocket in the vicinity of a proximal end of each flap;

whereby, the thigh dorsal strap and the torso dorsal strap are releasably attachable one to the other in a range of lengths by:

interposing the tang between the flaps; or interposing the tang between the flaps and inserting a distal portion of the tang into the pocket; and engaging the hook components with the loop components.

9. The sling of claim 1, wherein each seat handle comprises webbing and is attached to the thigh band in a dorsal region of the thigh band.

10. The sling of claim 1, wherein the one or more side handles comprise webbing and there are two side handles.

11. The sling of claim 1, further comprising one or more front handles, each front handle comprising webbing and being attached to the torso band at a ventral region of the torso band.

12. The sling of claim 1, further comprising one or more lifting lugs for engagement with a lift connector and located in a superior dorsal region of the torso band.

13. The sling of claim 1, wherein one or more of the handles comprises identifying indicia.

14. The sling of claim 13 wherein the identifying indicia comprises a contrasting colour or a light-reflective material or both.

15. The sling of claim 1 wherein the sling comprises a washable synthetic fabric.

16. A sling for use by two attendants in lifting and transporting a person with limited mobility, the sling comprising:

a releasably securable thigh band having a thigh band circumferential length when the thigh band is releasably secured wherein the thigh band circumferential length is adjustable;

a releasably securable torso band having a torso band circumferential length when the torso band is releasably secured wherein the torso band circumferential length is adjustable;

a length-adjustable dorsal strap comprising:

a thigh dorsal strap, integral with the thigh band;

a torso dorsal strap, integral with the torso band; and means for releasably attaching the thigh dorsal strap and the torso dorsal strap one to the other in a range of lengths;

two seat handles attached to the thigh band; and one or more side handles attached to the torso band at a dorsal region of the torso band;

wherein, in use:

the length of the dorsal strap is adjusted for the height of a person with limited mobility;

with the dorsal strap located dorsal to the person:

the thigh band is releasably secured about the thighs of the person; and the torso band is releasably secured about the torso of the person; and lifting of the person by two attendants comprises:

one attendant grasping one of the seat handles;

the other attendant grasping the other of the seat handles; and the attendants grasping the one or more side handles.

17. The sling of claim 16, wherein:

the thigh band comprises:

an inner thigh band;

an outer thigh band; and a first buckle component attached to the outer thigh band in the vicinity of a distal end of the outer thigh band; and a second buckle component configured for releasable connection with the first buckle component and mounted on a thigh adjustment webbing having a thigh adjustment webbing first end affixed to the inner thigh band in the vicinity of the distal end of the inner thigh band and a thigh adjustment webbing second end affixed to the inner thigh band proximal of the thigh adjustment webbing first end, wherein the second buckle component:

is slidable along the thigh adjustment webbing when the thigh adjustment webbing is slack; and tends to remain in position along the thigh adjustment webbing when the thigh band is releasably secured so as to bring thigh adjustment webbing under tension; and the torso band comprises:

an inner torso band;

an outer torso band; and a third buckle component attached to the outer torso band in the vicinity of a distal end of the outer torso band; and a fourth buckle component configured for releasable connection with the third buckle component and mounted on a torso adjustment webbing having a torso adjustment webbing first end affixed to the inner torso band in the vicinity of the distal end of the inner torso band and a torso adjustment webbing second end affixed to the inner torso band proximal of the torso adjustment webbing first end, wherein the fourth buckle component:

is slidable along the torso adjustment webbing when the torso adjustment webbing is slack; and tends to remain in position along the torso adjustment webbing when the torso band is releasably secured so as to bring the torso adjustment webbing under tension.

18. The sling of claim 16, wherein:

one of the thigh dorsal strap and the torso dorsal strap comprises a tang having one of a hook component or a loop component of a hook and loop fastener on both an inside and an outside of the tang; and the other of the thigh dorsal strap and the torso dorsal strap comprises:

two flaps, each flap having the other of the hook component or the loop component of the hook and loop fastener on the side of the flap facing the other flap;

a pocket suitable for receiving the tang with an entrance of the pocket in the vicinity of a proximal end of each flap;

whereby, the thigh dorsal strap and the torso dorsal strap are releasably attachable one to the other in a range of lengths by:

interposing the tang between the flaps; or interposing the tang between the flaps and inserting a distal portion of the tang into the pocket; and engaging the hook components with the loop components.

19. The sling of claim 16, wherein:

each seat handle comprises webbing and is attached to the thigh band in a dorsal region of the thigh band; and the one or more side handles comprise webbing and there are two side handles.

20. The sling of claim 16, further comprising:

one or more front handles, each front handle comprising webbing and being attached to the torso band at a ventral region of the torso band; and one or more lifting lugs for engagement with a lift connector and located in a superior dorsal region of the torso band.

* * * * *